US006627044B2

(12) United States Patent
Suortti et al.

(10) Patent No.: US 6,627,044 B2
(45) Date of Patent: Sep. 30, 2003

(54) WEB GUIDE IN A PAPER MACHINE/BOARD MACHINE

(75) Inventors: Jari Suortti, Karhula (FI); Ville Nenonen, Vantaa (FI); Risto Väätäinen, Helsinki (FI); Erkki Kärkkäinen, Karhula (FI); Kari Paloniemi, Jyväskylä (FI); Samppa J. Salminen, Jyväskylä (FI)

(73) Assignee: Metso Paper, Inc., Helsinki (FI)

( * ) Notice: Subject to any disclaimer, the term of this patent is extended or adjusted under 35 U.S.C. 154(b) by 179 days.

(21) Appl. No.: 09/781,906

(22) Filed: Feb. 9, 2001

(65) Prior Publication Data

US 2002/0092638 A1 Jul. 18, 2002

(30) Foreign Application Priority Data

Feb. 9, 2000 (FI) ..... 20000269

(51) Int. Cl.[7] ..... D21F 1/00

(52) U.S. Cl. ..... 162/273; 162/289; 162/193; 226/21; 226/23; 226/179; 226/180; 226/195

(58) Field of Search ..... 162/273, 289, 162/193; 226/21, 22, 23, 24, 179, 180, 195

(56) References Cited

U.S. PATENT DOCUMENTS 5,653,331 A * 8/1997 Graf ..... 198/807

* cited by examiner

*Primary Examiner*—Steven P. Griffin
*Assistant Examiner*—M. Halpern
(74) *Attorney, Agent, or Firm*—Steinberg & Raskin, P.C.

(57) ABSTRACT

The invention concerns a guide (10) for the web, such as the wire or felt, in a paper machine/board machine. The guide is formed by a bearing housing (12) at one end of a guiding roller (11) in such a way that the bearing housing (12) includes a curved surface as the rolling surface (13). An actuator (14) is adapted to roll the bearing housing along a stop face ($T_1$), whereby by using the actuator (14) an essentially linear transfer is given to a shaft stub (11$a_1$) pivoted by a bearing (15$a_1$) in the bearing housing (12).

8 Claims, 9 Drawing Sheets

WEB GUIDE IN A PAPER MACHINE/BOARD MACHINE

This application claims priority of Application 20000 269 filed in Finland Feb. 9. 2000.

FIELD OF THE INVENTION

This invention concerns a web guide in a paper machine or a board machine.

Various web guiding solutions based e.g. on link mechanisms are known in the state of the art. The web guide is a device solution, wherein the web is transferred

BACKGROUND OF THE INVENTION in a controlled manner transversely in relation to the machine direction by moving either end of the web guide roller in the machine direction. Thus, the end of the web guide roller includes a transfer mechanism in a state-of-the-art manner. The known web guides are based e.g. on parallel transfers, whereby the end shaft of the roller can be moved in the machine direction by using joint structures and the roller can thus be deflected at its other end, so that its shaft can be placed in an oblique angle in relation to the machine direction. Hereby the web, such as the wire or felt, of the paper machine which is guided on the roller or along it, is transferred laterally towards either the front side or the back of the machine. The distance of motion required in the adjustment is comparatively short, just a few tens of millimeters. The state-of-the-art mechanisms are comparatively complicated and their construction is cumbersome. This means that servicing of the constructions is difficult.

In the known web guides, the transfer mechanisms transfer the transferable pivoted shaft of the guiding roller along an arc of a circle. This causes problems in doctoring of the roller, because the doctor beam must then be able to turn in its lengthwise direction for the doctoring to take place reliably.

There are e.g. bellows mechanisms known in the state of the art, whereby with the aid of air pressure supplied into the bellows a force is directed at a lever structure, and the shaft stub of a guiding roller attached to the lever mechanism is thus affected.

The known device solutions are not either suitable for all positions. This is so because the roller guide may be located in such a way that the web travels vertically upwards, whereby the web guide roller is located on the said run of web and the force of gravity is applied in different ways to supporting bearing constructions than in horizontal positions.

This application presents a new type of guide structure for use in a paper machine or in a board machine, wherein the essential feature is the use of a bearing housing as the rolling element. Thus, at least one shaft stub of the web guide roller includes such a bearing structure, wherein the bearing housing is adapted to roll against a stop face. To bring about rolling, an actuator is used, which connects with the bearing housing, so that by using the actuator the bearing housing may be rotated along its stop face in the desired direction. Either one actuator or two actuators may be used in the invention to move the bearing housing, whereby if one actuator is used, the return motion and a counterforce may be achieved e.g. by using a spring. Another purpose of the actuator is to keep the rolling surface of the bearing housing firmly against the stop face.

In the guide solution according to the invention, the guide is thus replaced e.g. with a cylindrical bearing housing of the roller. Such an embodiment is also possible, wherein the curvature of only a certain area and angular sector of the bearing housing is utilised.

In the guide solution according to the invention, a separate rolling surface and a separate actuator unit can be connected to the bearing housing. Hereby the guide according to the invention is especially suitable for already existing guiding rollers. The existing guide is hereby removed and the solution according to the invention is installed in one bearing of the guiding roller, and a sliding surface, unless such a surface does not already exist, is installed in the frame structure of the paper machine/board machine.

The bearing housing acting as a guide is moved by either one actuator or by two actuators, which may be a hydraulic/pneumatic cylinder/air bellows/mechanical conveyor screw.

The bearing housing rolls along the base in a linear motion. Should electric/hydraulic/pneumatic power failures occur, the roller will remain in its place supported by the base.

The following is a presentation by way of summary of the advantages achieved through the device solution according to the invention: the guide is reliable in operation contains no sliding surfaces friction-free owing to the rolling motion it needs very little space, since only the actuator needs space few components, whereby the construction is advantageous linear motion contains no wearing components requiring service doctoring of the roller takes place reliably.

BRIEF DESCRIPTION OF THE DRAWINGS

In the following, the invention will be described with reference to some advantageous embodiments of the invention shown in the figures of the appended drawings, to which embodiments, however, the invention is not exclusively limited.

FIG. 4 shows an embodiment of the invention, wherein the curved rolling surface of the bearing housing is formed by a gear surface. The gear is adapted to roll against the straight teeth of the.

DETAILED DESCRIPTION OF THE INVENTION

Figure 1A:
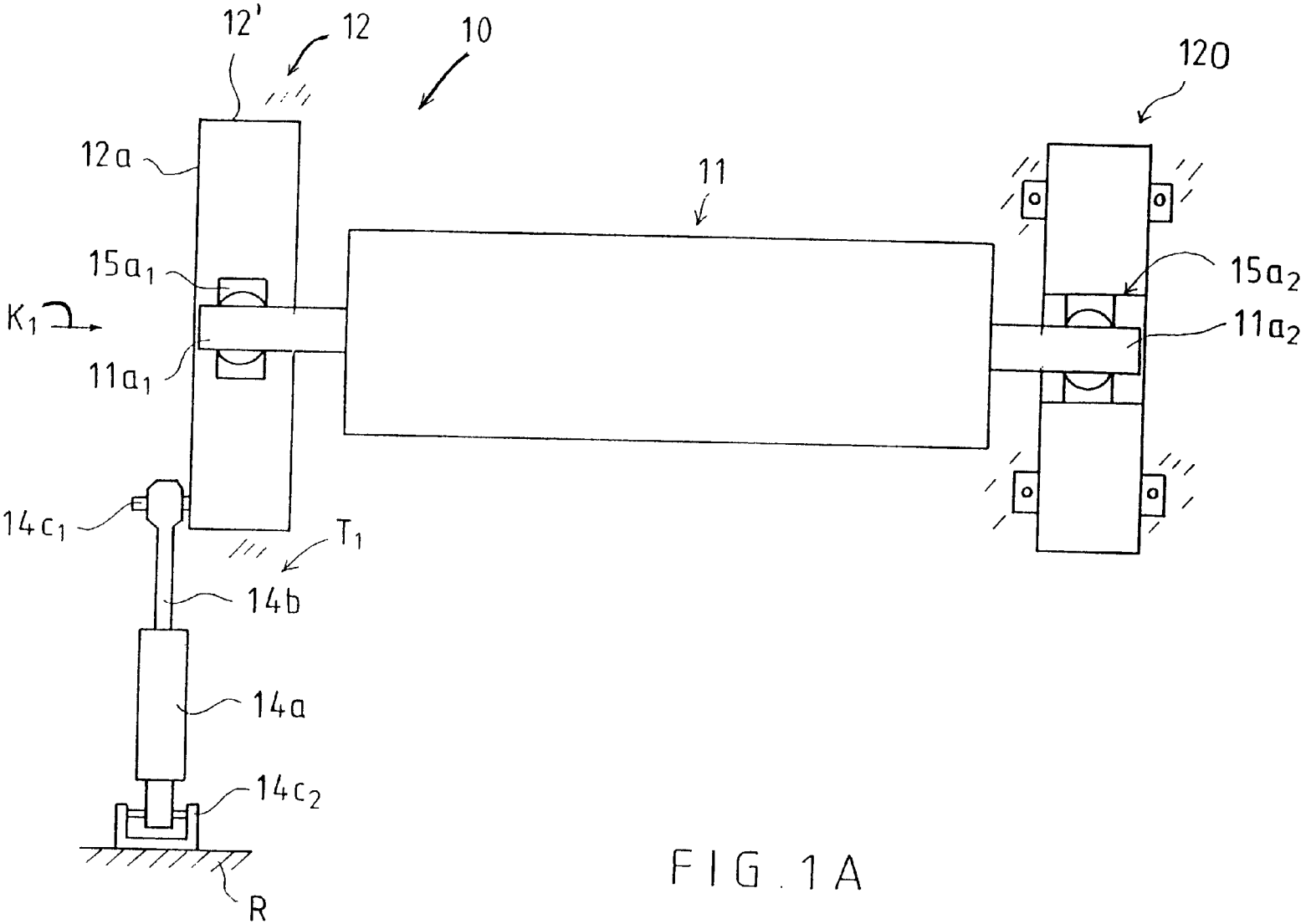
FIG. 1A shows a view from above of the guide according to the invention.

FIG. 1A shows a view from above of the guide according to the invention. Web $H_1$ (see FIG. 1C) is brought in between guide 10 and guiding roller 11. The bearing housing 12 according to the invention is located on one side of guiding roller 11, while a bearing housing 120 is located on the other side of the guiding roller. Bearing housing 120 is an ordinary construction allowing a certain change of angle on shaft 11$a_2$ of guiding roller 11. The figures presented in this application show bearings 15$a_1$ 15$a_2$ schematically as ball sliding bearings. It is obvious that bearing 15$a_1$ may consist of roller or ball bearings, whereby a certain total change of angle a is permitted on the bearing race.

Figure 1B:
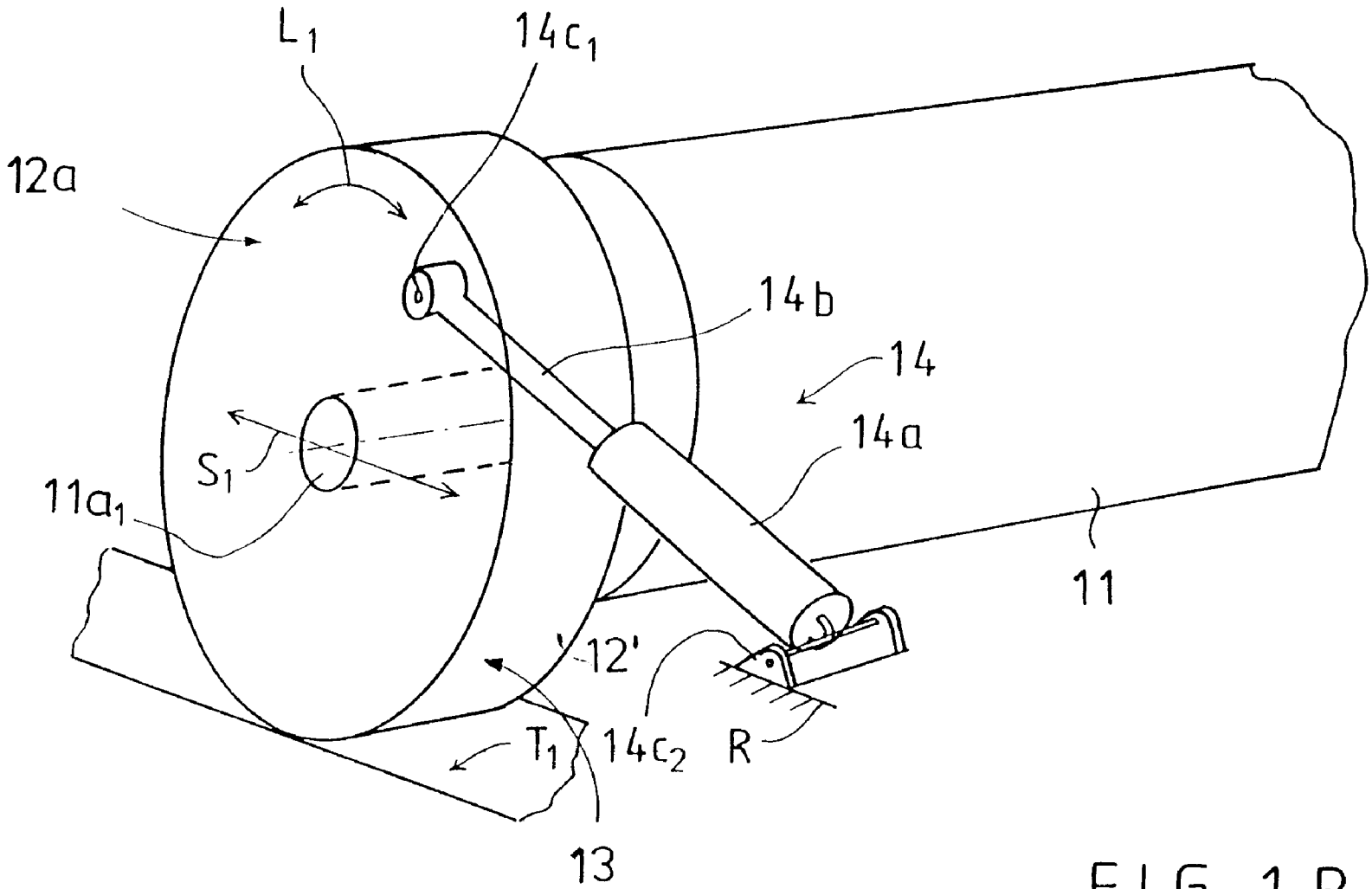
FIG. 1B shows the guide according to FIG. 1A in the direction of arrow $K_1$ of FIG. 1A.

FIG. 1B shows a guide in accordance with FIG. 1A seen in the direction of arrow $K_1$ of FIG. 1A. Bearing housing 12 includes a rolling surface 13. An actuator 14, which is preferably a screw actuator or a cylinder actuator, is connected pivotally at its one end with the machine frame R and at its other end with side face 12*a* of bearing housing 12. If the actuator 14 is a cylinder actuator, it is preferably either a hydraulic cylinder or a pneumatic cylinder. Bearing housing 12 preferably includes as an outer race surface 12' a cylindrical surface, which acts as the rolling surface 13, when bearing housing 12 is moved by rolling it along its planar stop face $T_1$. The bearing housing is rolled along its curved race surface 12', which surface is preferably a circular cross-section or part of a circular cross-section. The radius of the said circular cross-section is preferably located in such a way that the centre of the radius is located on the geometric central axis of shaft stub 11$a_1$ of guiding roller 11. The required horizontal transfer distance from the mid-position one way or the other is a few tens of millimeters. Between shaft 11$a_1$ of guiding roller 11 and the bearing housing 12 there are bearing means 15$a_1$, which act as pivoting means for the rotation of guiding roller 11. When the bearing housing is moved by rolling, the geometric central axis of the guiding roller shaft, that is, of shaft stub 11$a_1$, will move along a linear path, which means that it will remain at the same height.

Figure 1C:
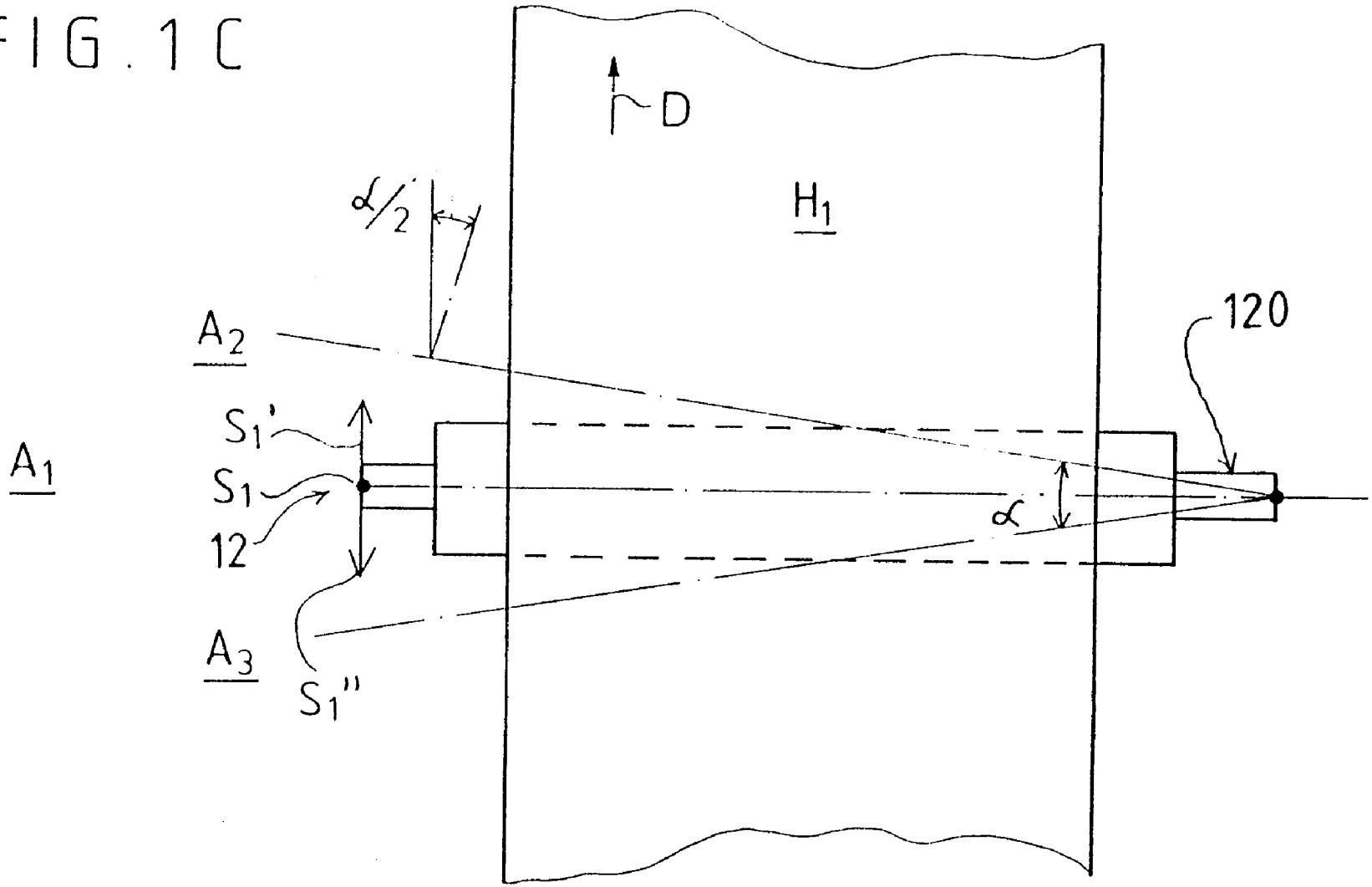
FIG. 1C is a schematic view of the guide in both extreme positions of adjustment.

FIG. 1C shows two extreme positions $A_2$, $A_3$ of the guide. The extreme positions $A_2$, $A_3$ are indicated by dashed lines. Letter D shows the travelling direction of web $H_1$. FIG. 1C is a schematic view of the central position of guiding roller 11 and it shows how the left end of the roller as seen in the figure is moved to both extreme positions $A_2$, $A_3$ of the guide. The central position is marked as $A_1$. The linear motion of the geometric central axis of the guiding roller 11 is indicated by arrows $S_1$. The motion upwards from central position $A_1$ as shown in the figure is indicated by arrow $S_1$', while the adjusting motion downwards is indicated by arrow $S_1$'. When bearing housing 12 is moved from the central position $A_1$ in direction $S_1$', the web $H_1$, such as a felt or wire, which is guided in parallel on guiding roller 11 (arrow D), is deflected to the right in the figure in the travelling direction of the web. When bearing housing 12 is moved from the central position $A_1$ in the direction indicated by arrow $S_1$", the web is deflected to the left in the travelling direction of the web as shown in FIG. 1C.

As is shown in FIG. 1A, rolling of bearing housing 12 in the structure is made possible by the fact that bearing 15$a_2$ of bearing housing 120 at one end of guiding roller 11 allows a certain change of angle for the shaft stub 11$a_2$ at the said end. The total area of angular change is indicated by arrow $\alpha$ in the figure. Correspondingly, the pivoting means 15$a_1$ of the bearing housing 12 according to the invention must be able to allow a similar angular change $\alpha$ for shaft stub 11$a_1$ of guiding roller 11.

Figure 2A:
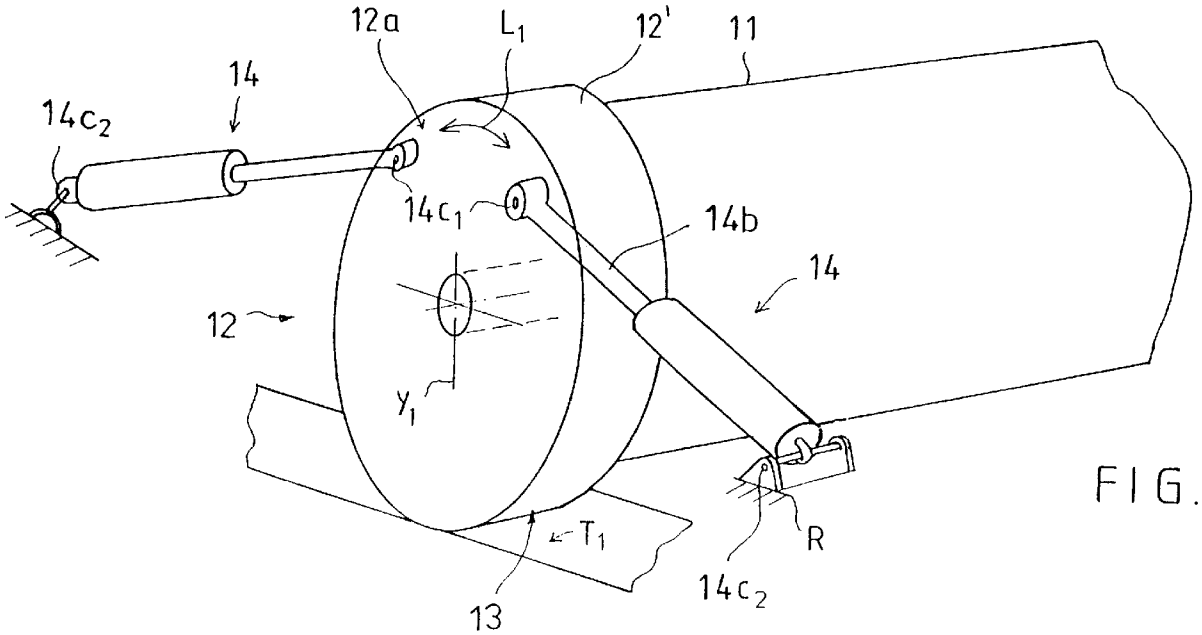
FIG. 2A is an axonometric view of the guide according to the invention, and the embodiment in the figure includes two actuators, which are used to roll the bearing housing.

FIG. 2A is an axonometric view of an embodiment of the invention, wherein there are two actuators 14. The actuators 14 in the figure are cylinder actuators. Hereby cylinder actuator 14 includes a piston rod 14*b*, which at its one end includes a joint 14$c_1$ and at the cylinder body 14*a* end a joint 14$c_2$. Joint 14$c_1$ is located on the front face 12*a* of bearing housing 12. Correspondingly, an actuator of a similar kind connects on the other side of the central line $Y_1$ of the bearing housing. Hereby the actuators are operated cross-wise in such a way that when the piston rod of one actuator is moving away from the cylinder, the piston rod of the actuator on the other side is moving within the cylinder. The actuators 14 may also be actuators of some other kind than cylinder actuators. If they are cylinder actuators, the actuators are preferably hydraulic cylinder actuators.

Figure 2B:
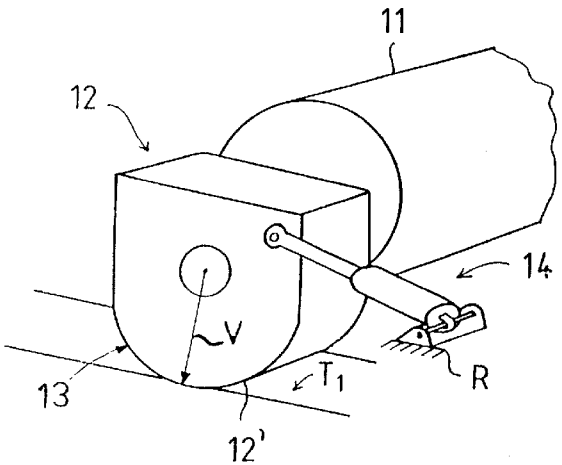
FIG. 2B shows an embodiment of the invention, wherein only one sector face of the bearing housing is curved, and this sector face is used for rolling the bearing housing.

FIG. 2B shows an embodiment of the invention, wherein the curved rolling surface 13 of bearing housing 12 is located only on a part of the outer race 12' of the bearing housing. Under these circumstances, rolling surface 13 is located in a certain angular sector, which is needed in order to bring about a linear motion and rolling of the bearing housing. The rolling surface is shaped like the arc of a circle and its radius is marked by the letter V.

Figure 2C:
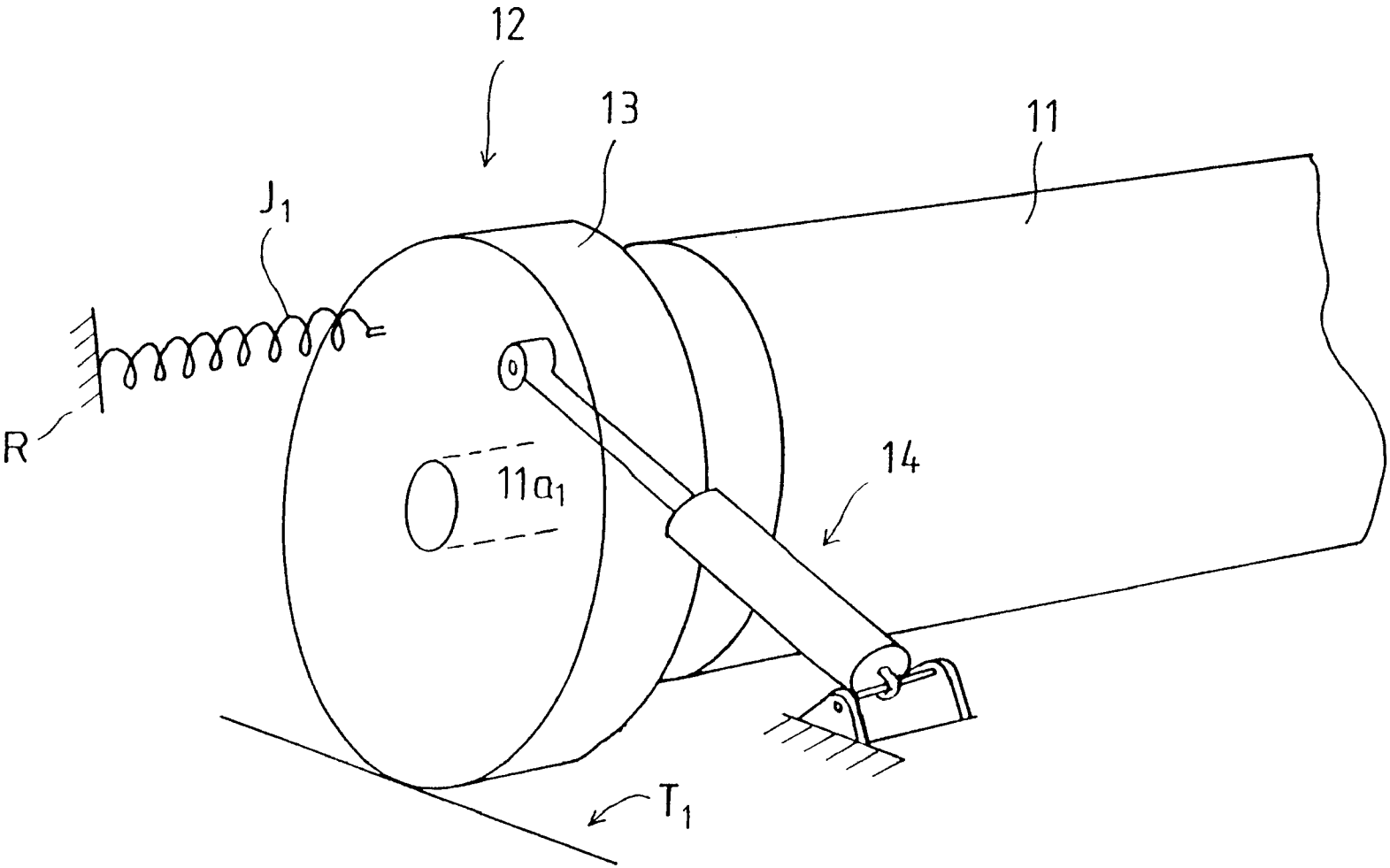
FIG. 2C shows an embodiment of the invention, which includes a spring to bring about a counterforce to the force created by the rolling of the actuator.

FIG. 2C shows an embodiment, wherein there is only one actuator 14 and where the counterforce to actuator 14 is provided by a spring $J_1$, which is located in between bearing housing 12 and frame R.

Figure 2D:
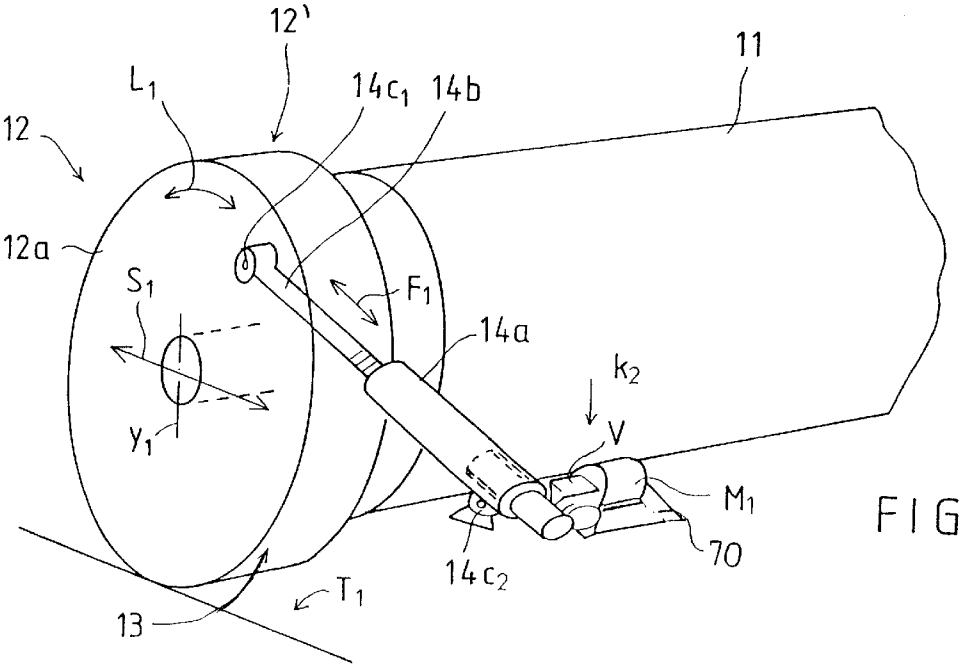
FIG. 2D shows an embodiment, wherein the actuator is a screw actuator.

FIG. 2D shows such an embodiment of the actuator, wherein the actuator is formed by a screw actuator. As is shown in FIG. 2D, actuator 14 connects in between frame R and the front face 12*a* of bearing housing 12. Hereby the bearing housing including cylindrical surface 12' is rolled. In this way a linear motion is brought about for shaft stub 11$a_1$ of roller 11, as the arrow $S_1$ shows in the figure. The rod 14*b* of actuator 14 is connected by a joint 14$c_1$ with bearing housing 12. In the figure, the vertical central line of shaft stub 11$a_1$ is marked by the letter y, and the linear motion is indicated by arrows $S_1$. The rolling motion of bearing housing 12 supported by the cylindrical surface 12' is indicated by arrows $L_1$ in FIG. 2D.

Figure 2E:
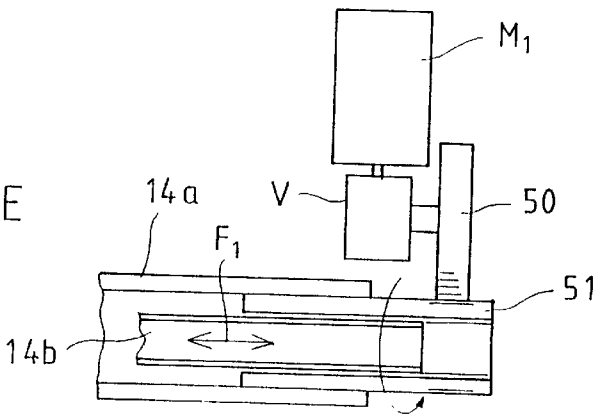
FIG. 2E shows a solution alternative for operating the screw actuator. The view is in the direction of arrow $K_2$ from FIG. 2D.

FIG. 2E shows an embodiment of the screw actuator 14, wherein the linear motion of rod 14*b* of the actuator is brought about in the following manner. Motor $M_1$ rotates through gear V a toothed gear 50, which connects with teeth in the end of bushing 51. Hereby bushing 51 is rotated and the bushing is further connected with rod 14*b*, which is located inside cylinder body 14*a*. The internal teeth of bushing 51 are connected with the external teeth of rod 14*b*. Thus, by operating motor $M_1$, rod 14*b* is moved, which is mounted to the front face 12*b* of bearing housing 12 in such a way that turning of rod 14*b* around its own axis is prevented, but rod 14*b* is allowed to turn in the plane of front face 12*a* of bearing housing 12. With the aid of the mechanism, rod 14*b* is thus moved in the manner shown by arrow $F_1$. In this way rolling is achieved for bearing housing 12 along planar surface $T_1$, and thus a linear motion $S_1$ is brought about for the geometric central axis of shaft stub $11a_1$. Motor $M_1$ together with its related structures is suspended from base 70, which base 70 is joined to the so-called cylinder body 14*a* of the equipment shown in FIG. 2C. Under these circumstances, motor $M_1$ is tilted by moving the rod together with cylinder body 14*a*.

Figure 3A:
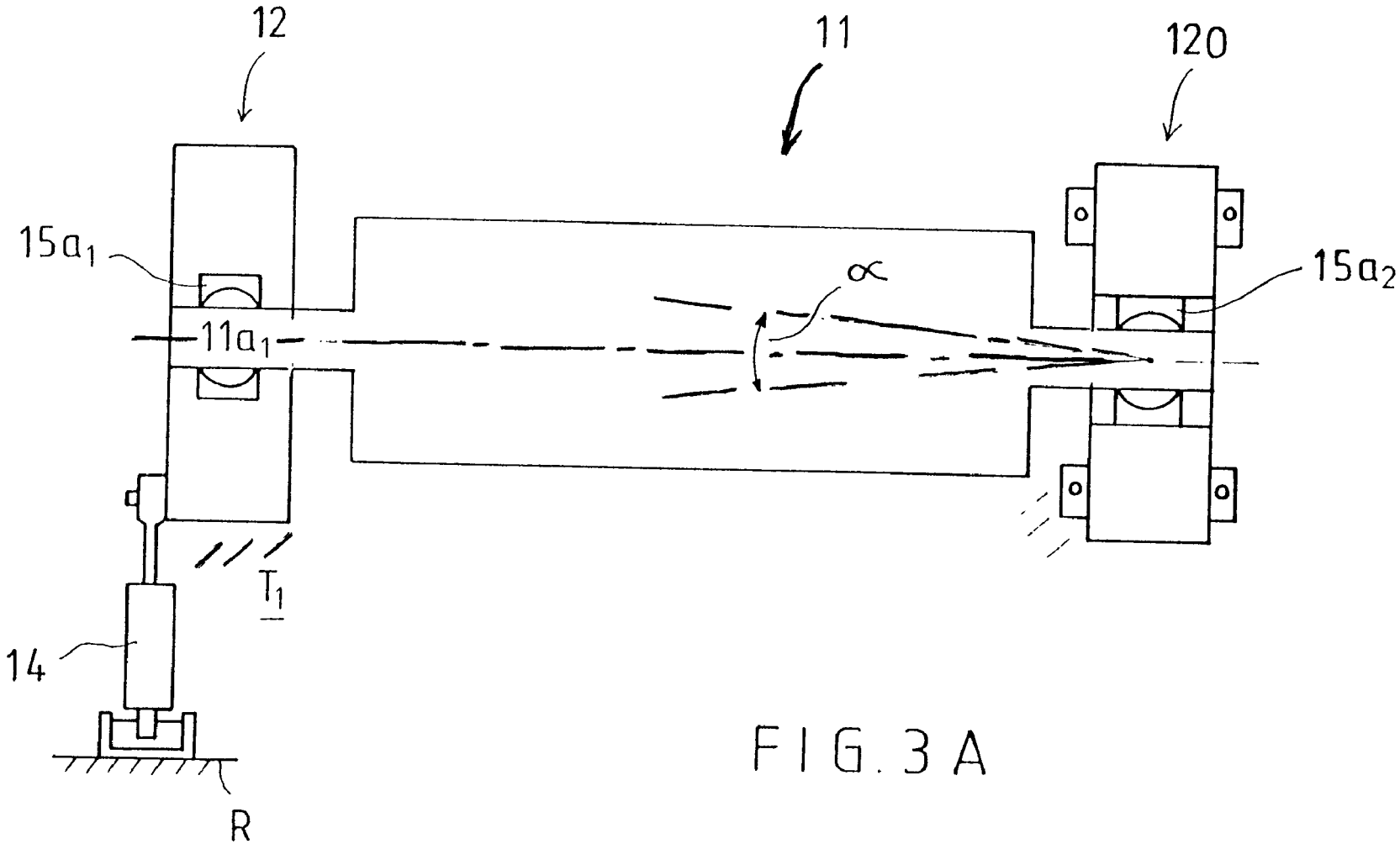
FIG. 3A shows an ordinary embodiment of the invention, wherein the pivoting for the rolling of the guiding roller is located in the bearing housing to be rolled.

FIG. 3A shows the most conventional embodiment of the guide according to the invention, wherein the outer surface 12' of the bearing housing 12 to be rolled according to the invention is formed by a cylindrical surface, which is rolled by an actuator/actuators 14 along its stop surface $T_1$. Pivoting means $15a_1$ are located in between the shaft stub $11a_1$ of guiding roller 11 and bearing housing 12. The pivoting means $15a_1$ are such that they allow for the shaft stub $11a_1$ of guiding roller 11 a certain angular change a required for rolling of bearing housing 12.

Figure 3B:
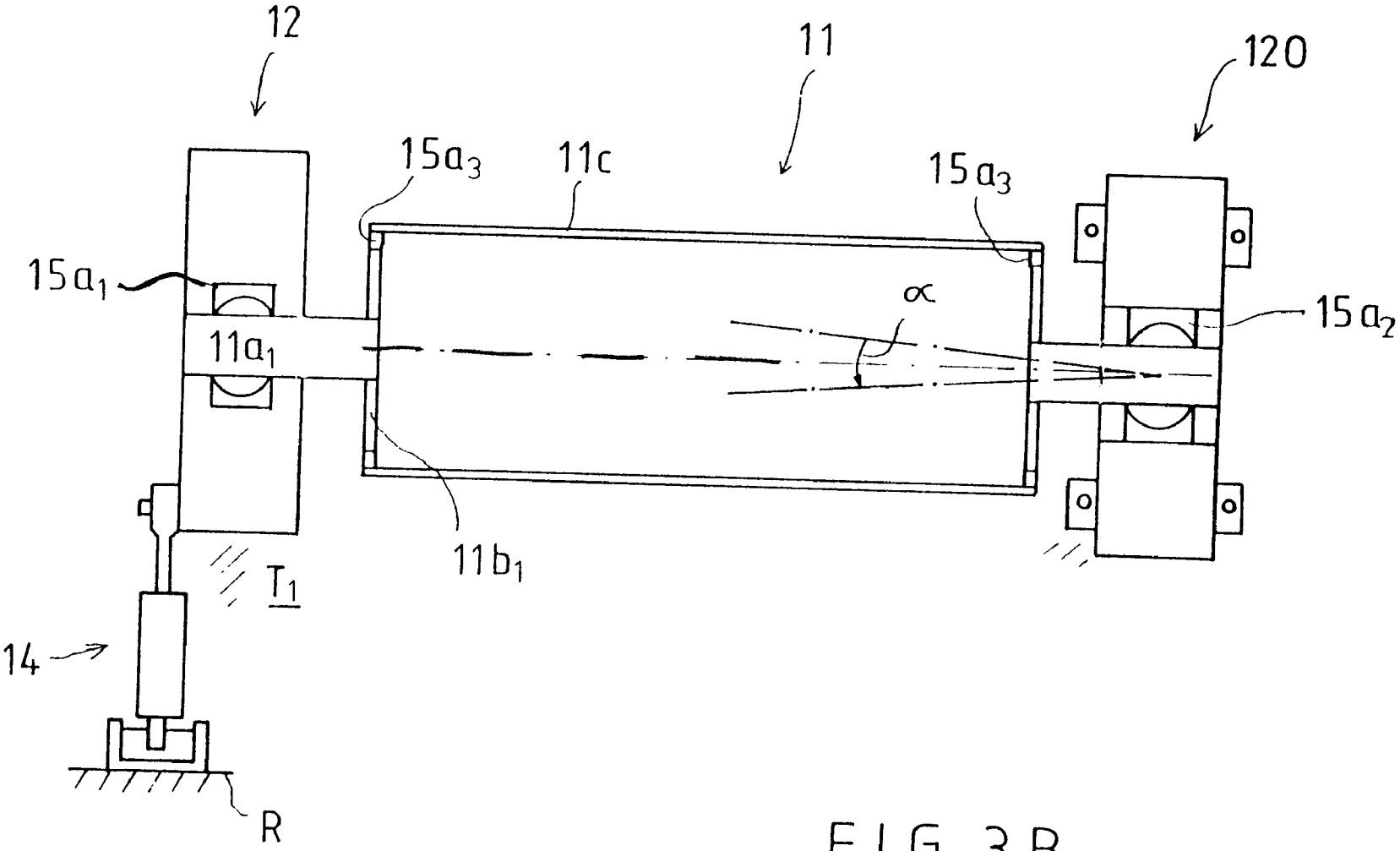
FIG. 3B shows an embodiment, wherein the guide is formed in a roller construction, wherein the bearing means proper of the guiding roller are located in between the roller flange and the jacket part of the roller and wherein the pivoting needed for the rolling motion is brought about by bearing means in between the shaft stub and the bearing housing.

FIG. 3B shows an embodiment of the invention, wherein the guiding roller includes pivoting means $15a_3$ in between jacket $11b_1$ of guiding roller $11a_1$ and jacket 11*c* of guiding roller 11. In the said embodiment, pivoting means are also needed at the bearing housing 12 to allow rolling of the bearing housing. Hereby there are pivoting means $15a_1$ between shaft stub $11a_1$ of guiding roller 11 and bearing housing 12, which allow an angular change $\alpha$ in order to roll bearing housing 12 along its stop surface $T_1$.

Figure 4:
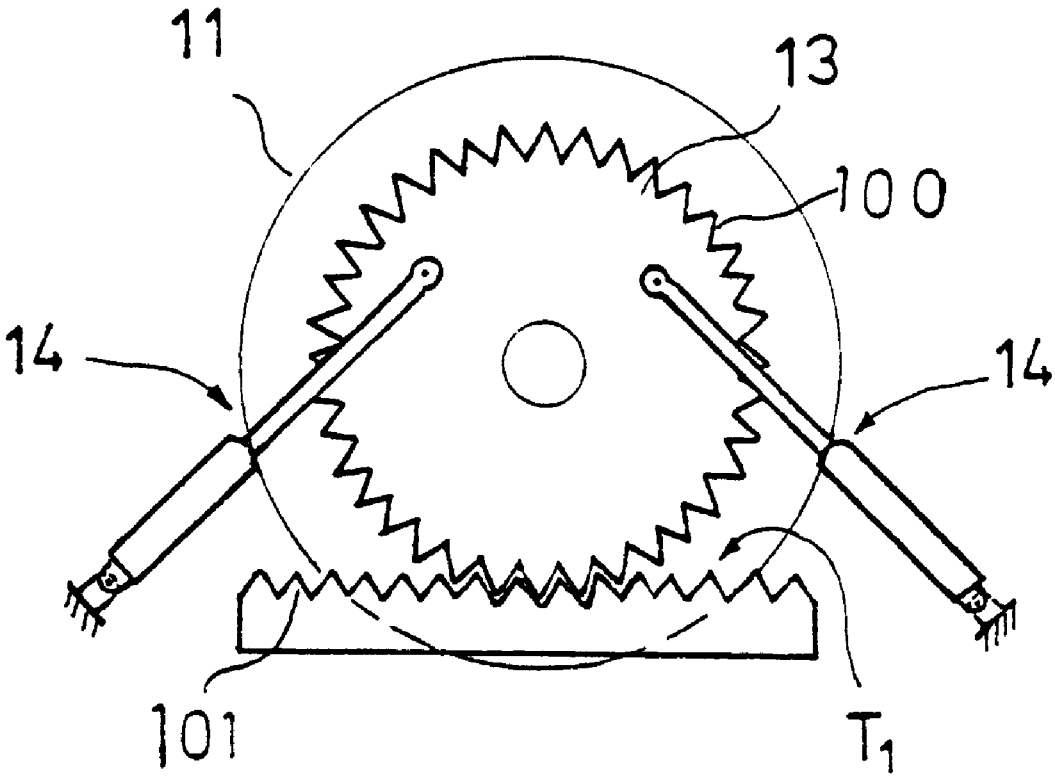

FIG. 4 shows an embodiment of the invention, wherein bearing housing 12 includes a gear 100 surface in the form of a curved rolling surface 13. Actuator 14 is adapted to roll the bearing housing along stop surface $T_1$, which is formed by a straight gear teeth 101.

What is claimed is:

1. A web guide for guiding a web in a paper or board machine, comprising:

a guiding roller (11) having a first shaft stub ($11a_1$) projecting from a first end thereof and structured and arranged to be movable in a linear direction and second shaft stub ($11a_2$) projecting from a second end thereof and structured and arranged to permit a pivotable movement of said guiding roller (11) thereabout;

a bearing housing (12) having a bearing ($15a_1$) structured and arranged in said bearing housing, wherein said bearing housing (12) is operatively coupled, via said bearing ($15a_1$), to said shaft stub ($11a_1$) of said guiding roller(11), said bearing housing (12) including a rolling surface (13) in contact with a stop face ($T_1$); and an actuator (14) operatively coupled to said bearing housing (12) for effectuating a linear movement of said bearing housing (12) and wherein said actuator is structured and arranged to linearly roll said bearing housing (12) along said stop face (T1), whereby said bearing ($15a_1$) permits an essentially linear transfer of movement of said actuator (14) to said stub shaft ($11a_1$).

2. The guide as claimed in claim 1, wherein said actuator (14) is one of a hydraulic and pneumatic cylinder.

3. The web guide according to claim 1, wherein said actuator (14) is a cylinder actuator having a cylinder body (14*b*) and a piston rod, wherein said cylinder body is operatively coupled at a first end to said machine frame (R) and at a second end to said piston rod, and wherein said piston rod is operatively connected at a first end to said cylinder body and at a second end to said front face of said bearing housing.

4. The web guide according to claim 1, wherein said bearing ($15a_1$) is structured and arranged to permit an angular movement (a) of said stub shaft ($11a_1$).

5. The web guide according to claim 1, further comprising:

a second bearing housing (120) having a second bearing ($15a_2$) structured and arranged therein and wherein said second stub shaft ($11a_2$) is operatively coupled to said second bearing ($15a_2$) and wherein said second bearing ($15a_2$) is structured and arranged to permit an angular movement ($\alpha$) of said second stub shaft ($11a_2$).

6. The web guide according to claim wherein said guiding roller ($11a_1$) includes a first jacket portion ($11b_1$) and a second jacket portion (11*c*), and further comprising:

a bearing ($15a_3$) arranged between said first jacket portion ($11b_1$) and said second jacket portion (11*c*).

7. The web guide according to claim 1, wherein said stop face (T) is a planar surface such that when said bearing housing (12) is moved along said stop face (T) said first bearing ($15a_1$) moves along a planar path.

8. The web guide according to claim 1, wherein said bearing housing (12) includes a rolling surface (13) having a plurality of teeth (100) said plurality of teeth (100) being structured and arranged to mate with a plurality of teeth on said stop face ($T_1$).

* * * * *